US009643292B2

(12) United States Patent
Ebert

(10) Patent No.: US 9,643,292 B2
(45) Date of Patent: May 9, 2017

(54) SINGLE AND TANDEM HONING DEVICES

(71) Applicant: James L. Ebert, Huron, OH (US)

(72) Inventor: James L. Ebert, Huron, OH (US)

( * ) Notice: Subject to any disclaimer, the term of this patent is extended or adjusted under 35 U.S.C. 154(b) by 435 days.

(21) Appl. No.: 13/679,372

(22) Filed: Nov. 16, 2012

(65) Prior Publication Data

US 2014/0141703 A1 May 22, 2014

(51) Int. Cl.
*B24B 33/08* (2006.01)

(52) U.S. Cl.
CPC ..... *B24B 33/085* (2013.01)

(58) Field of Classification Search
CPC ..... B24B 33/08; B24B 33/084; B24D 9/02; B24D 13/06; B24D 13/04; B24D 13/045; B65H 75/242; B65H 75/245
USPC ..... 451/463, 541, 547, 480, 484
See application file for complete search history.

(56) References Cited

U.S. PATENT DOCUMENTS 1,698,590 A * 1/1929 Harter ..... 451/480
1,774,711 A * 9/1930 Heon ..... 451/484
1,853,365 A * 4/1932 Lindroth ..... 451/464
2,465,225 A * 3/1949 Haren ..... 451/466
2,476,334 A * 7/1949 Titcomb ..... B24D 7/066 451/365
2,548,166 A * 4/1951 Larson ..... 451/506
2,580,327 A * 12/1951 Sunnen ..... 451/470
2,612,010 A * 9/1952 Phillips ..... B24B 33/083 451/473
3,276,170 A * 10/1966 Crowe ..... 451/540
3,462,887 A * 8/1969 Hackman, Jr. ..... 451/541
8,690,644 B2 * 4/2014 Uchiumi ..... B23B 29/02 451/464
2012/0028550 A1 * 2/2012 Uchiumi ..... B23B 29/02 451/464

FOREIGN PATENT DOCUMENTS

WO WO 2010114076 A1 * 10/2010

* cited by examiner

*Primary Examiner* — Joseph J Hail
*Assistant Examiner* — Joel Crandall
(74) *Attorney, Agent, or Firm* — David D. Murray; Vivacqua Law, PLLC

(57) ABSTRACT

A honing tool or device having a generally cylindrical body includes a plurality of axially extending webs to which are attached a like plurality of curved honing blades. A portion of the external surface of each blade remote from the attachment point includes an abrasive coating. The radius of curvature of the portion of the blades including the abrasive coating is nominally the same as the radius of the desired finish diameter of the bore. Resilient dampers are disposed behind the blades in the body to dampen vibrations. An additional plurality of webs may be disposed behind the blades to limit their inward translation. A double or tandem honing device includes a pair of the just described honing tools which are arranged in axially spaced apart relationship on a common shaft.

16 Claims, 6 Drawing Sheets

SINGLE AND TANDEM HONING DEVICES

FIELD

The present disclosure relates to honing devices and more particularly to single honing tools and tandem honing devices which provide improved control and accuracy of the honing process.

BACKGROUND

The statements in this section merely provide background information related to the present disclosure and may or may not constitute prior art.

Honing is generally defined as an abrasive machining process that produces a precision surface on a metal workpiece. It is most generally utilized to provide a smooth, dimensionally accurate finish on internal cylindrical surfaces such as the cylinder walls of internal combustion engines. This is achieved by moving one or more abrasive stones or hones on or over the surface of the workpiece, typically by simultaneously rotating the hones and translating (oscillating) them axially.

While the process is related to and often compared to grinding, the basic nature of the process renders it most suitable for precision final treatment of metal workpieces such as, as noted above, cylinders and similar bores. This precision is the result of the simultaneous rotation and axial oscillation of the hones which come in contact with a large area of the workpiece thereby averaging out both the imperfections of the hones and the bore. This averaging effect occurs in all honing processes and contributes to the accuracy and smooth finish of honed surfaces, especially bores.

Conventional hones and honing apparatus experience a common difficulty and that is controlling or limiting the dimensional increase in bore diameter during honing. That is, most honing machines utilized in machine shops rotate and axially oscillate the hones while the adjustable radial force applied to the hones is controlled by a foot pedal. Thus, although metal removal by honing is relatively slow compared to grinding, most machines depend upon the skill of the operator to efficiently and accurately control or limit the dimensional increase of a workpiece by honing. Obviously, overhoning a workpiece with the result that the completed bore, though smooth, is oversized is not only undesirable but may result in scrapping the workpiece. As explained above, however, although conventional hones are capable of providing extremely smooth inner cylindrical surfaces, dimensional control can be difficult due to the uncontrolled spring bias of the honing tool stones, i.e., the hones will continue to enlarge an opening as long as the tool is used.

An additional problem of honing is maintaining true and accurate on-center honing, especially if the axial length of the bore is relatively short. While this is less a problem in large, dedicated honing machines, maintaining true, on center honing with portable or hand held equipment can be difficult in the best of circumstances.

From the foregoing, it is apparent that improvements in both honing equipment and processes are both desirable and possible.

SUMMARY

The present invention provides a novel honing tool or device having a generally cylindrical body including a plurality of axially and radially extending webs to which are attached a like plurality of curved honing blades. A portion of the external surface of each blade remote from the attachment points includes an abrasive coating. The radius of curvature of the curved portion of the blades including the abrasive coating is nominally the same as the radius of the desired finish diameter of the bore. A resilient damper is disposed behind each of the curved blades in an axial passageway in the body of the device. An additional plurality of vanes may be disposed behind the blades to limit their inward translation. Thus, the blades have a limited range of radial translation. The invention also comprehends a double or tandem honing device wherein a pair of the just described honing tools are arranged in axially spaced apart relationship on a common shaft.

While the honing tool or device of the present invention is usable with many components and products, it is especially useful for finishing (honing) bearing openings in steering knuckles undergoing repair. The steering knuckle repair process utilizing the honing tools of the present invention typically first involves one or more passes, i.e., a rough cut and a final cut, with a boring bar to achieve an oversized, reasonably smooth surface in the two bearing openings. A bronze sleeve or liner is then installed in each oversized opening. The blades of one or of a tandem honing tool are slightly radially compressed by an operator and inserted into the sleeve or the pair of axially spaced apart sleeves. The honing tool is then rotated and axially oscillated.

As the honing and bore enlargement progress, the torque required to rotate the honing tool(s) and the reaction torque of the honing tool(s) lessens relatively quickly because of the limited radial travel of the honing blades. When the proper bore diameter has been achieved, the honing tool will rotate relatively freely within the bore. This is an indication to the operator that the honing process is complete. Thus it will be appreciated that a honing process utilizing the honing tools of the present invention is essentially self-limiting or self-controlling. Additionally, with a pair of axially spaced apart bores and two correspondingly spaced apart honing tools, maintenance of accurate, on axis honing is assured.

Thus it is an aspect of the present invention to provide an improved honing tool.

It is a further aspect of the present invention to provide a honing tool having a plurality of curved, stiffly resilient honing blades.

It is a still further aspect of the present invention to provide a honing tool having a plurality of curved resilient honing blades including outer surfaces coated with an abrasive.

It is a still further aspect of the present invention to provide a honing tool having a plurality of curved resilient honing blades including damper material disposed behind each of the blades in a passageway in the tool.

It is a still further aspect of the present invention to provide a honing device having a pair of axially spaced apart honing tools each having a plurality of curved resilient honing blades.

It is a still further aspect of the present invention to provide a honing tool having a plurality of curved resilient honing blades especially suited for honing bearings in vehicle front axles.

It is a still further aspect of the present invention to provide a honing device having a pair of axially spaced apart honing tools each having a plurality of curved resilient honing blades especially suited for honing bearings in vehicle front axles.

Further aspects, advantages and areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

Figure 6:
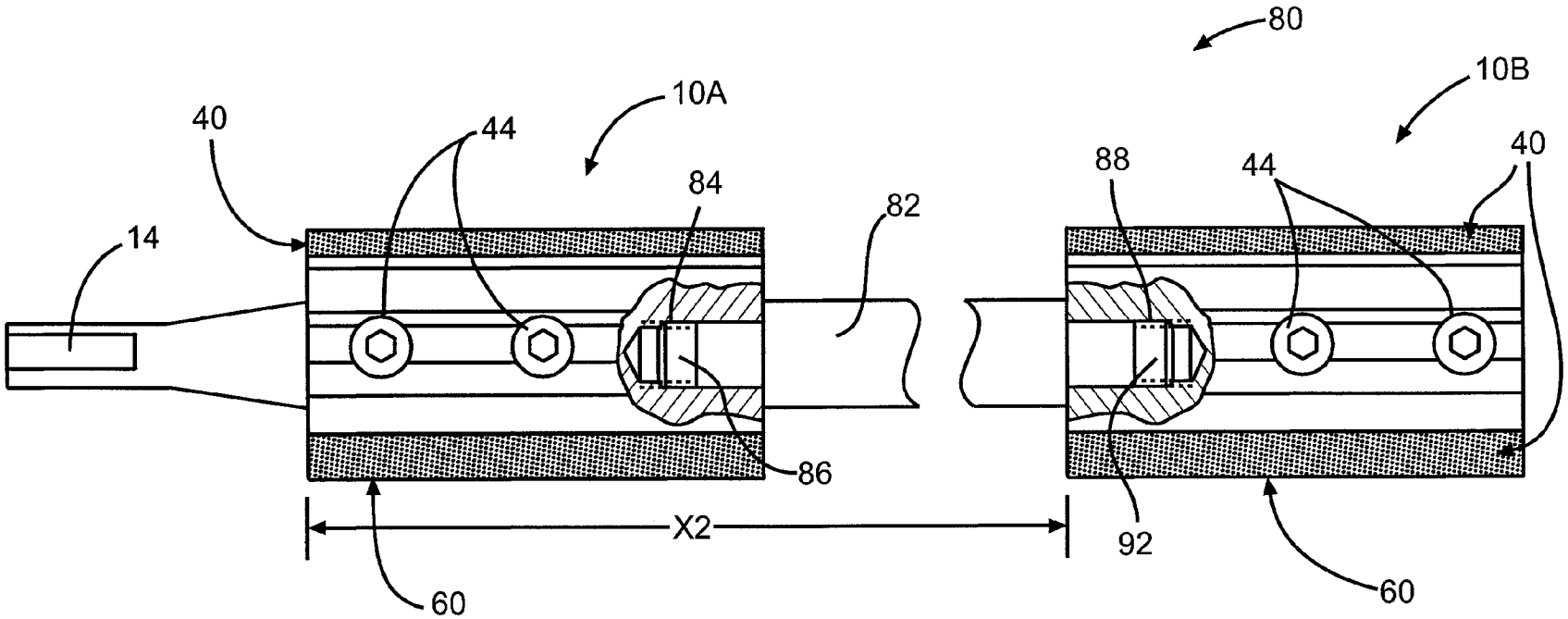
Figure 7:
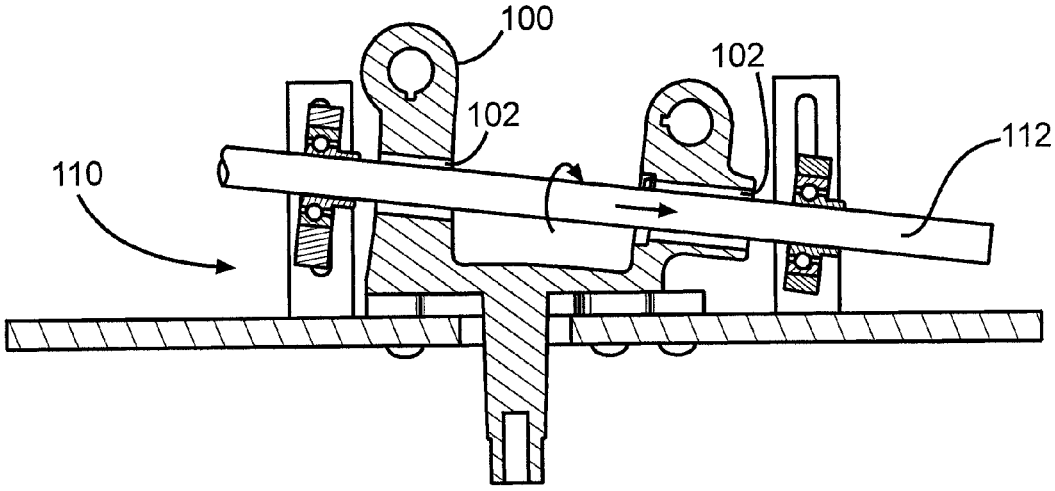
Figure 8:
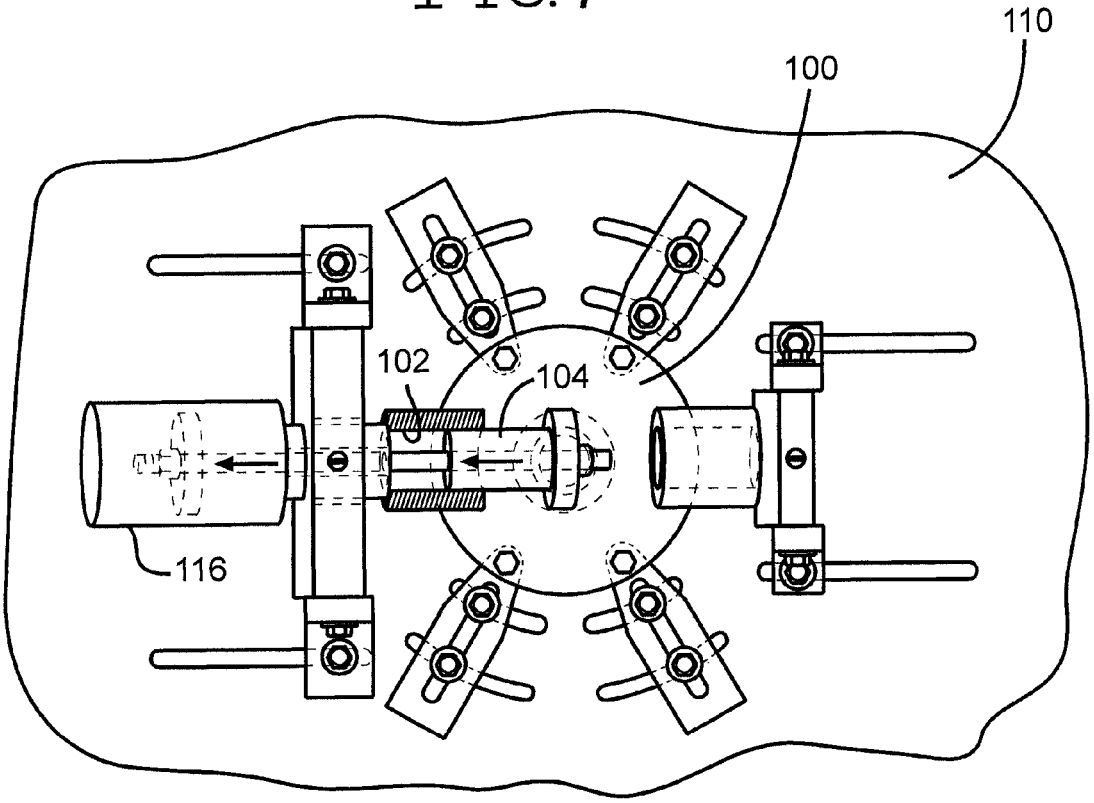
Figure 9:
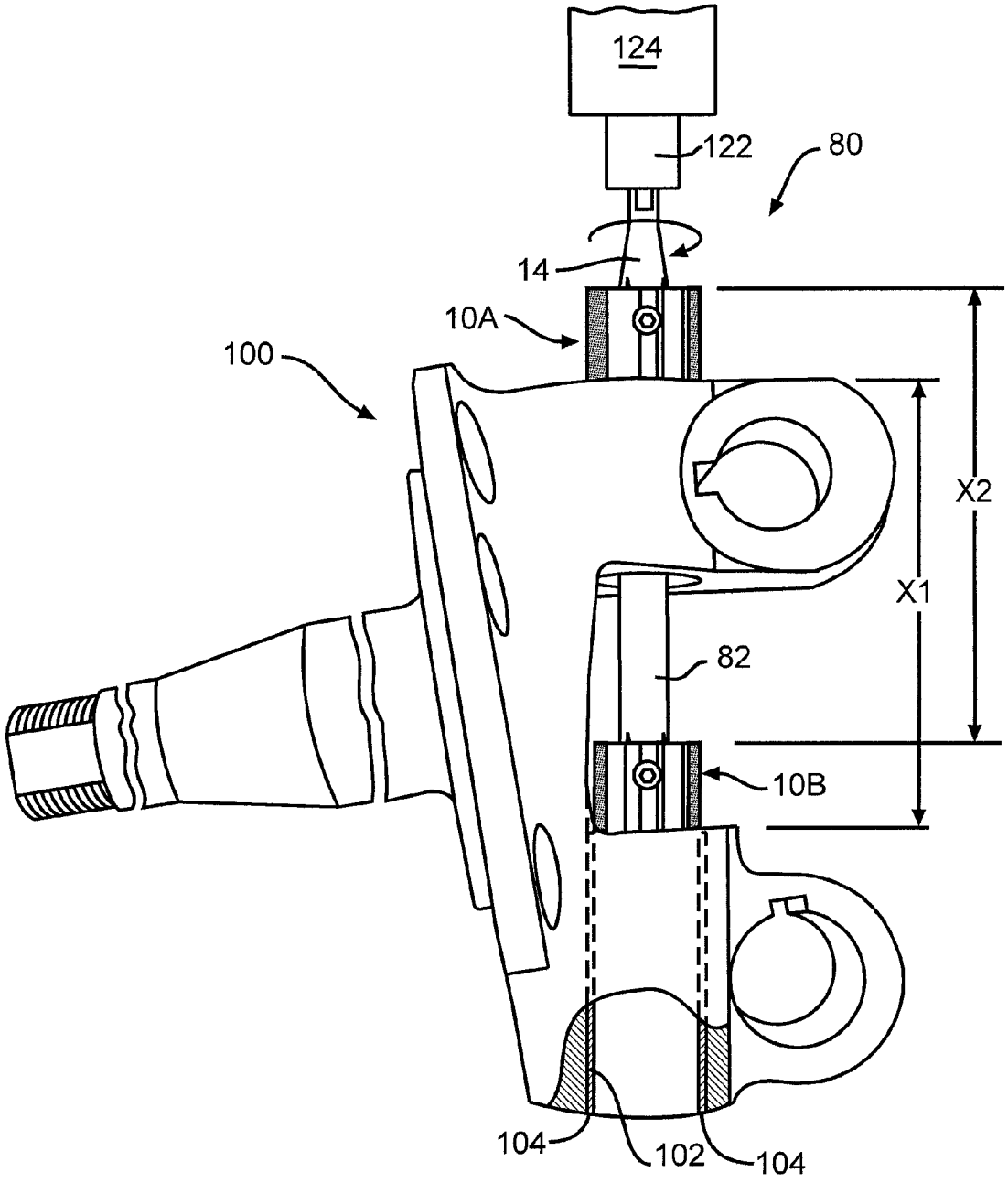

FIG. 6 side, elevational view of a embodiment of a double honing device according to the present invention;

FIG. 7 is a side, elevational view in partial section of a first, boring step in a steering knuckle repair process;

FIG. 8 is a top, plan view in partial section of a second, sleeve inserting step in a steering knuckle repair process; and FIG. 9 is a perspective view of a third, bearing honing step in a steering knuckle repair process utilizing the double honing device of FIG. 6.

DETAILED DESCRIPTION

The following description is merely exemplary in nature and is not intended to limit the present disclosure, application, or uses.

Figure 1:
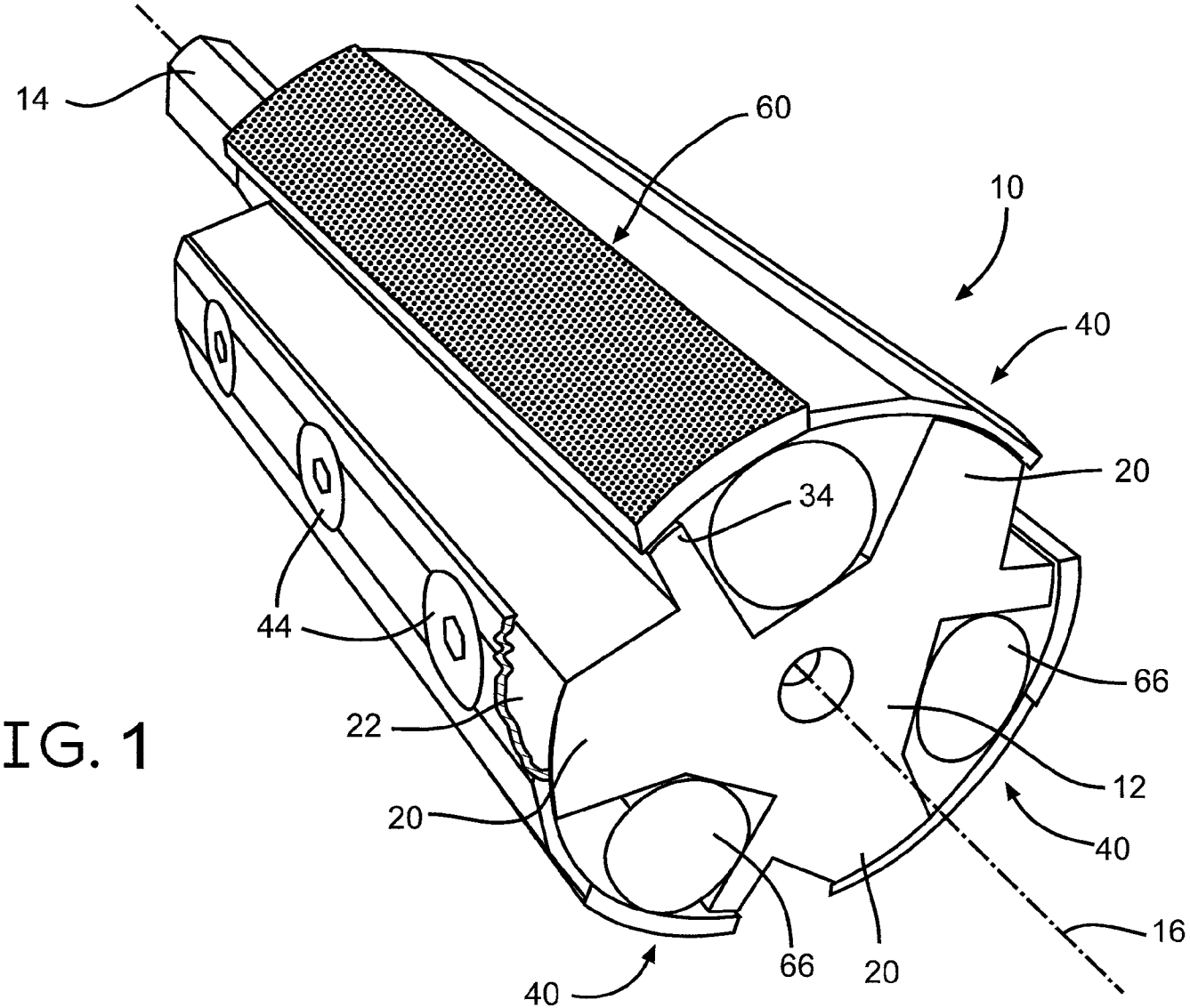
FIG. 1 is a perspective view of a honing tool or device according to the present invention.
Figure 2:
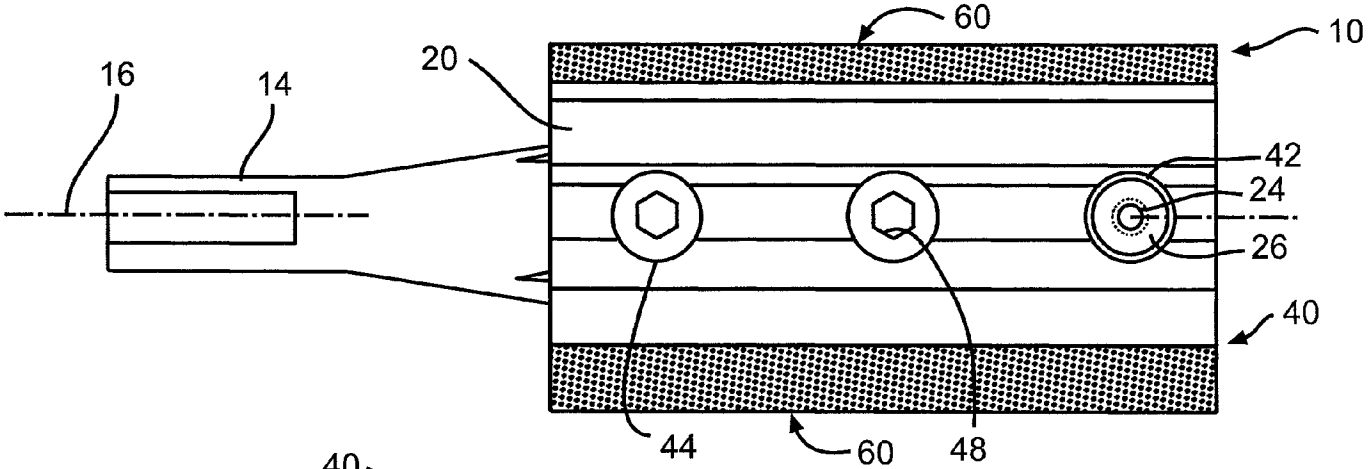
FIG. 2 is side, elevational view of a honing tool according to the present invention.
Figure 3:
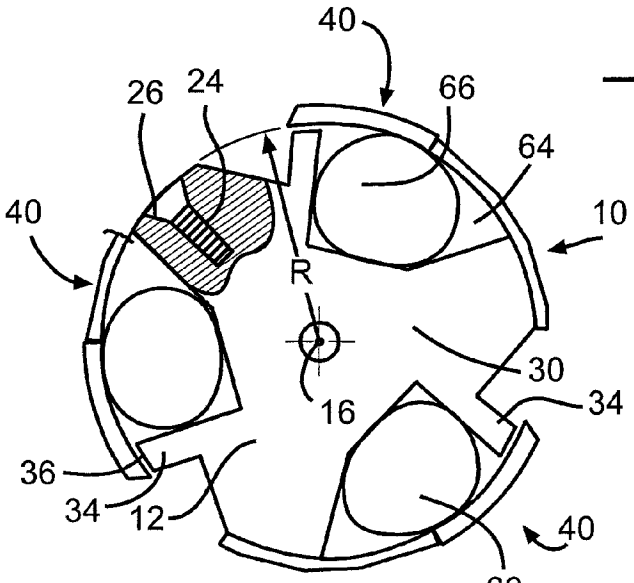
FIG. 3 is an end view of a honing tool according to the present invention with a portion broken away.

With reference to FIGS. 1, 2 and 3, a single honing tool or device according to the present invention is illustrated and designated by the reference number 10. The honing tool or device 10 includes a body 12 having a generally cylindrical shape or exterior and a stub shank or shaft 14 both co-axially disposed on a center or reference axis 16. The stub shank or shaft 14 is preferably sized in both length and diameter so that it is readily received and secured within a conventional chuck or collet of a power tool such as a drill (illustrated in FIG. 9).

The cylindrical body 12 defines a first plurality of, preferably three, axially extending segments or webs 20. The cylindrical body 12 may, alternatively, define or include two, four or more segments or webs 20. Typically, though not necessarily, cylindrical bodies 12 having relatively smaller diameters may include two segments or webs 20 whereas relatively larger diameter cylindrical bodies 20 may include four or more segments or webs 20. The segments or webs 20 each include an outer curved, radiused surface 22 having a plurality, typically two, three or four radially oriented threaded blind openings 24. The threaded blind openings 24 preferably include a countersunk, i.e., frusto-conical, surface 26. Circumferentially adjacent each of the segments or webs 20 is one of a like plurality of axially extending support ribs or vanes 34. The support ribs or vanes 34 include an axially and circumferentially extending, outer oblique surface 36 which is slightly recessed, i.e., disposed radially inward, from the radiused surfaces 22 of the segments or webs 20. As will be more fully explained subsequently, the support ribs or vanes 34 act as stops or bumpers to limit radially inward translation of the honing blades 40, described below. Limiting the radially inward translation of the honing blades 40 prevents portions of the honing blades 40 from deflecting and exceeding their elastic limits and thus being moved out of a proper, operable honing position as described in greater detail below.

Figure 4:
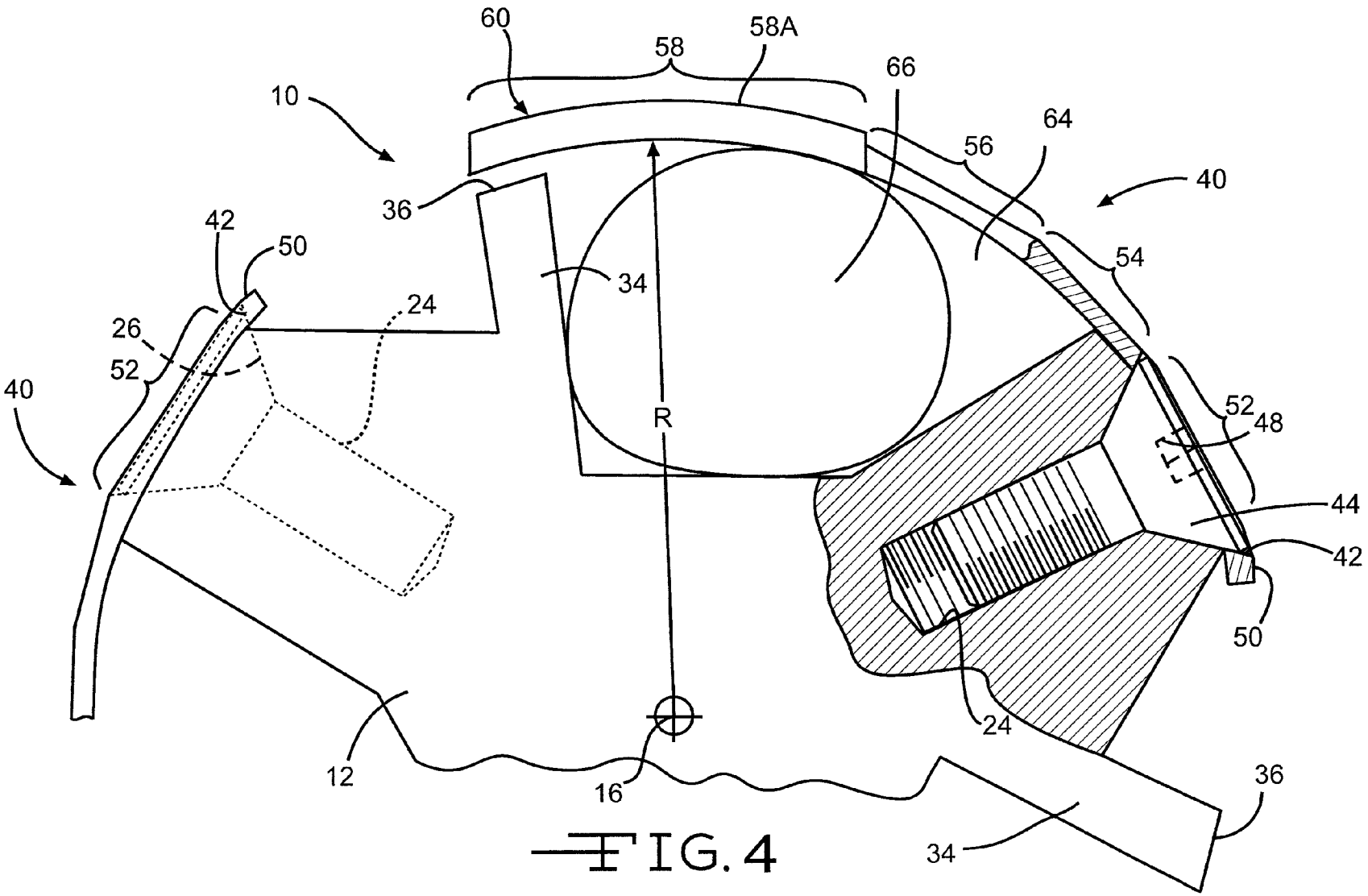
FIG. 4 is an enlarged end view of a honing tool according to the present invention with a portion broken away.

With reference now to FIGS. 1, 2 and 3 and particularly FIG. 4, secured along each of the outer radiused surfaces 22 of the segments or webs 20 is a respective honing blade 40. Just as, as explained above, the cylindrical body 20 may include two, three, four or more segments or webs 20, the number of honing blades 40 may vary, it being understood that one blade 40 is associated with each segment or web 20. Each of the honing blades 40 includes a plurality of chamfered openings 42 defining an angle and an inner diameter which align with the countersunk surfaces 26 in the segments or webs 20. The chamfered openings 42 each receive a threaded fastener 44 having a frusto-conical head 46 which is complementary to and seats within the chamfered opening 42 and the countersunk blind threaded openings 24 in the segments or webs 20. As will be apparent subsequently, it is important that the threaded fasteners 44, particularly the heads of the fasteners 44, extend radially outwardly an absolute minimum distance and preferably not at all from the outer surface of the honing blades 40. Thus, not only are the openings 42 chamfered and the threaded openings 24 countersunk but also the threaded fasteners 44 preferably include a hex socket 48 or similar female drive fitting which minimizes the size, especially the height, of the head of the fastener 44.

The honing blades 40 each define a structure having a plurality of zones and surfaces of different thicknesses and shapes along their circumference. A first narrow circumferential zone and outer surface 50 has a thinnest region adjacent the edge of the blade 40 and increasing thickness away from the edge of the blade 40. The inner surface of the first circumferential zone and surface 50 and of all the other zones and surfaces is a continuous, smooth, radiused surface "R." There is a second thicker circumferential zone and outer flat surface 52. The second circumferential zone and outer flat surface 52 includes the chamfered openings 42 and serves to mount the honing blade 40 to the segments or webs 20 of the cylindrical body 12. There is a third thinner circumferential zone and outer flat surface 54. The third circumferential zone and outer flat surface 54 partially controls or provides the resilience (spring constant) of the honing blade 40 and thus the honing force or pressure on the workpiece. A fourth thinner circumferential zone and outer flat surface 56 is similar to the third circumferential zone 54. The fourth thinner circumferential zone and outer flat surface 56 also controls and provides additional resilience (spring constant) to the honing blade 40.

A fifth thicker circumferential zone and outer surface 58 includes both a radiused outer surface 58A and the radiused inner surface "R." The radiused outer surface 58A of the fifth zone 58 of the blade 40 is coated with an abrasive 60. The abrasive 60 is preferably cubic boron nitride (CBN) which may be applied by electroplating or another material deposition process and which may successfully be used with steel or bronze. Alternatively, a diamond abrasive 60 may be applied to the outer surface 58A of the fifth circumferential zone 58 which may be successfully used with bronze.

Fine or coarse abrasive 60 may be applied to the outer surface 58A of the fifth circumferential zone 58 of the blade 40. A fine abrasive 60 for the honing tool 10 is preferably in the range of from about 150 grit to 210 grit with an operable range of from about 120 grit to 240 grit. A fine abrasive 60 is preferably applied to the outer surface 58A of the fifth zone 58 to a thickness of about 0.007 inches (0.178 mm.). A coarse abrasive 60 for the honing tool 10 is preferably in the range of from about 80 grit to 100 grit with an operable range of from about 60 grit to 120 grit. A coarse abrasive 60 is preferably applied to the outer surface 58A of the fifth circumferential zone 58 to a thickness of about 0.012 inches (0.305 mm.).

Preferably residing behind each of the blades 40 and more specifically behind the fourth zone 56 and the fifth zone 58, in axial passageways 64 are a plurality of resilient dampers 66. The dampers 66 are, in their relaxed state, preferably cylindrical and are fabricated of polyurethane having a Shore A durometer hardness of 40. It should be understood that other resilient materials such as rubber and other elastomers may be utilized rather than polyurethane and that the Shore A hardness of the dampers 66 may vary in the range of from 38 to 42 and wider depending upon such variables as the size of the tool 10, the stiffness of the blades 40 and the nominal speed of rotation of the tool 10. The dampers 66 damp vibrations and chatter of the blades 40 and thus improve the smoothness of the honed surface produced by the honing tool 10.

Figure 5:
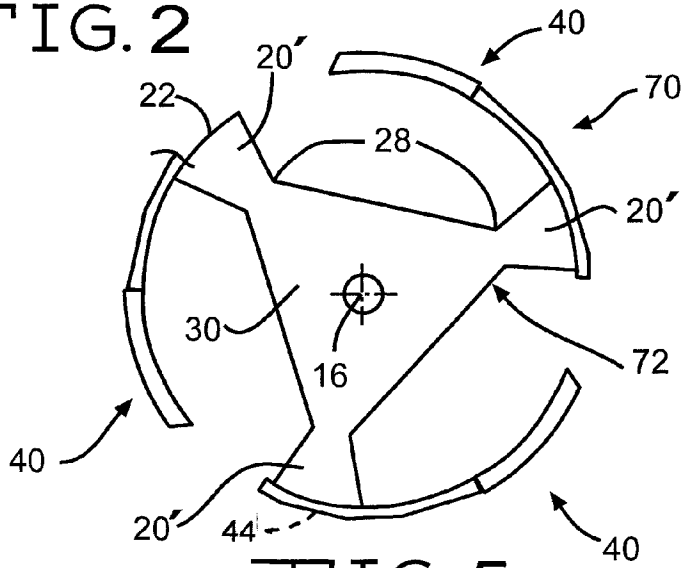
FIG. 5 is an end view of an alternate embodiment of a honing tool according to the present invention.

Referring now to FIG. 5, an alternate embodiment honing tool or device is illustrated and designated by the reference number 70. The alternate embodiment honing tool or device 70 is the same as the honing tool or device 10 in most respects and includes a cylindrical body 72, the plurality of, preferably three, axially extending segments or webs 20' and the like plurality of blades 40. The difference is that it lacks the support ribs or vanes 34. There are thus no stops or bumpers to limit radially inward translation of the honing blades 40. Additionally, the segments or webs 20' generally describe or define "X's" when viewed end on and are wide (circumferentially thicker) at their outer surfaces 22 to accept the fasteners 44. Their width preferably decreases with decreasing distance from the center axis 16 of the tool or device 70 to a reduced thickness throat or neck 28 and then increases to form a generally triangular body section 30 centered upon the reference axis 16. It should be appreciated that the alternate embodiment honing tool or device 70 may include the resilient dampers 66, illustrated in FIGS. 1, 3 and 4, disposed behind the blades 40, if desired. Moreover, it should be understood that more or fewer than three of the segments or webs 20' may be utilized in the tool or device 70.

Referring now to FIG. 6, a double honing device according to the present invention is illustrated and generally designated by the reference number 80. The double or tandem honing device 80 includes a pair of honing tools 10 which in FIG. 6 are designated the first honing tool 10A and the second honing tool 10B (or a pair of the alternate embodiment honing tools 70) disposed, arranged and mounted in tandem to, on or integrally formed with an intermediate shank or stub shaft 82. One of the honing devices (the first honing device 10A in FIG. 6) includes the integrally formed shank or stub shaft portion 14 that may be received within and engaged by a drive member. On the opposite end of the first honing tool 10A from the stub shaft portion 14, is a first threaded blind opening 84 which receives a first threaded male end 86 of the intermediate stub shaft 82. On one end of the second honing tool 10B is a second threaded blind opening 88 which receives a second threaded male end 92 of the intermediate stub shaft 82. Two honing tools 10A and 10B may thus be readily assembled and dis-assembled by threading and tightening the stub shaft 82 into the threaded openings 84 and 88 of the honing tools 10A and 10B or vice versa.

Referring now to FIGS. 6 and 9, the center to center (or same edge to same edge) axial spacing "X1" between adjacent bearings 102 in a steering knuckle 100 is preferably the same as or substantially the same as the center to center (or same edge to same edge) axial distance "X2" between the first honing tool 10A and the second honing tool 10B of the double honing device 80. Such axial disposition thus duplicates the spacing of the steering knuckle bushings which ensures, to the extent possible, that the honing tools 10A and 10B will simultaneously and equally hone and enlarge the bearing openings 102 as will be more fully explained below. It will be appreciated that to adjust the axial distance "X2," one of a plurality of intermediate stub shafts 82 of distinct lengths may be selected and threaded into (between) the first and second honing tools 10A and 10B.

Referring now to FIGS. 6, 7, 8 and 9 the honing process on the bearing openings of the typical steering knuckle 100 with the double honing device 80 according to the present invention is illustrated. As illustrated in FIG. 7, the bearing (king pin) openings 102 of the steering knuckle 100 are machined with the equipment disclosed and claimed in my U.S. Pat. No. 7,716,799 granted May 18, 2010 according to the process disclosed and claimed in U.S. Pat. No. 7,832,073, granted Nov. 16, 2010 which are hereby incorporated by reference. In this process, the steering knuckle 100 is secured in a steering knuckle boring fixture 110 and a boring bar 112 is aligned with the axis of the bearing openings 102. The bearing openings 102 are machined to both enlarge them to receive a sleeve and to ensure their circularity and axial alignment, typically with a rough cut and a finish cut. Upon completion of machining, the boring bar 112 is removed and a sleeve or liner 104 is installed in each of the bearing openings 102 either manually or with a hydraulic tool 116, as illustrated in FIG. 8.

Then, as illustrated in FIG. 9, the shank or shaft 14 of the double honing device 80 is secured within a chuck or collet 122 of a power tool 124 such as a cordless or corded drill. The blades 40 of the honing device 80 are then gently manually pressed radially inwardly and both honing tools 10A and 10B of the double honing device 80 are inserted into the sleeves 104 within the bearing openings 102. The double honing device 80 is then rotated and axially oscillated (alternately bi-directionally translated) within the sleeves 104 to provide both an improved inner surface finish and the final desired inside sleeve diameter.

At this point of the repair process, the configuration of the honing tools 10A and 10B (as well as of the devices 10 and 70) becomes important. As noted above, conventional prior art honing tools include spring biased hones which have, with regard to the honing process, essentially unlimited radial travel and thus abrade and hone metal, increasing, essentially without limit, the inside diameter of a bore. Here, however, the blades 40 of the honing tools 10, 10A, 10B and 70 have a relatively high spring constant and limited radial travel: they are compressed slightly when inserted in to the sleeves 104 such that they apply between one and ten pounds of pressure per square inch and with relatively little radial translation, due to enlargement of the sleeve 104, return to their relaxed positions or nearly so and exert minimal pressure.

Thus, with relatively little metal removal and little diametral increase, the blades 40 relax and provide less force which allows the honing tool 10 to rotate more easily within the sleeve 104. Such easy rotation of the honing tool 10 is an indication that the sleeve 104 has reached the desired inside diameter, i.e., just slightly larger than the diameter of the king pin (not illustrated). Thus, because of the configuration of the honing tool 10, particularly the blades 40, the honing operation is substantially self-limiting or self-controlling.

The steering knuckle 100 can now be re-assembled to the axle by inserting the kingpin through the sleeves 104 in the bearing openings 102 and the opening in the end of the axle and re-attachment of the steering components to the steering knuckle 100 (all not illustrated).

It will be appreciated that although utilization of the present invention has been described in conjunction with use of the double hone device 80 on the steering knuckle 100, the double hone device 80 has application to any honing process or procedure requiring honing of two axially spaced apart cylindrical surfaces and the single hone tools 10 and 70 may be used in any honing application of a single cylindrical surface. Alternatively, the single hone tools 10 and 70 may be used with axially spaced apart cylindrical surfaces although, typically the result, i.e., the axial alignment and concentricity of the two or more cylindrical surfaces will not be that achievable with the double hone device 80. Also, in this regard, it should be understood that more than two, i.e., three, four or more, honing tools 10A and 10B, etc. may be mounted on or integrally formed with a common shaft such as the shaft 82 to simultaneously hone multiple axially spaced apart cylindrical openings.

The foregoing description of the invention is merely exemplary in nature and variations that do not depart from the gist of the invention are intended to be within the scope of the invention. Such variations are not to be regarded as a departure from the spirit and scope of the invention.

What is claimed is:

1. A honing tool comprising, in combination, a generally cylindrical body defining a plurality of axially extending webs, each of said webs having an outer surface and a plurality of radially oriented threaded openings extending into each of said webs, and a plurality of axially extending ribs, one of said ribs disposed between each pair of said plurality of axially extending webs, a like plurality of curved metal blades disposed on a respective one of said outer surfaces, each of said curved metal blades having a first thicker axially extending region having a plurality of openings aligned with said radially oriented threaded openings in said webs, a second thinner, resilient region adjacent said first region and a third, thicker region adjacent said second region carrying an abrasive coating, threaded fasteners extending through said openings in said curved metal blades and into said radially oriented threaded openings in said webs for securing said curved metal blades to said body, and a shank connected to and extending axially from said generally cylindrical body and adapted to be received within a drive member for rotating said body and blades.

2. The honing tool of claim 1 wherein said plurality of ribs each have an outer end disposed radially inward of said outer surface portion of said curved metal blades.

3. The honing tool of claim 1 wherein said curved blades include axially and circumferentially extending regions of distinct thickness.

4. The honing tool of claim 1 wherein said generally cylindrical body also defines an axial passageway adjacent each of said webs and further including a resilient damper disposed in each of said axial passageways.

5. The honing tool of claim 1 wherein said abrasive coating is one of cubic boron nitride and diamond having a grit of between 60 and 240.

6. The honing tool of claim 1 wherein said abrasive coating is electroplated to a thickness of between about 0.007 inches and 0.012 inches.

7. A tandem honing tool comprising, in combination, a pair of honing devices spaced apart along an axis and connected by a coaxial member, each of said honing devices including:

a generally cylindrical body defining three axially extending webs each having an outer surface and a plurality of radially oriented threaded openings extending into each of said webs, a curved metal blade disposed on each of said outer surfaces, said curved metal blades having an outer portion including an abrasive coating, and an axially extending end portion having a plurality of openings aligned with said radially oriented threaded openings in said webs, threaded fasteners extending through said openings in said curved metal blades into said radially oriented threaded openings in said webs for securing said curved metal blades to said generally cylindrical body, three axially extending ribs, one of said ribs disposed radially inwardly of each of said curved metal blades and between each pair of said three axially extending webs, and a shank connected to and extending axially from one of said generally cylindrical bodies and adapted to be received within a drive member for rotating said bodies and blades.

8. The honing tool of claim 7 wherein said generally cylindrical bodies define an axial passageway behind said outer portion of each of said blades and further including a resilient damper disposed in said axial passageway.

9. The honing tool of claim 7 wherein said abrasive coating is one of cubic boron nitride and diamond having a grit of between 60 and 240.

10. The honing tool of claim 7 wherein said curved blades include axially and circumferentially extending regions of distinct thickness.

11. The honing tool of claim 7 wherein said curved blades include at least a first thicker region adjacent said outer surface of said webs, a second thinner, resilient region adjacent said first region and a third, thicker region including said coating.

12. A tandem honing device comprising, in combination, a pair of cylindrical honing tools spaced apart along an axis and connected by a coaxial member, each of said honing tools including:

a generally cylindrical body defining a plurality of axially extending webs, each of said webs having an outer surface, and a plurality of radially oriented threaded openings extending into each of said webs, and a plurality of axially extending ribs, one of said ribs disposed between each pair of said plurality of axially extending webs, a like plurality of curved metal blades disposed on a respective one said outer surfaces, each of said curved metal blades having an outer portion including an abrasive coating and an axially extending end portion having a plurality of openings aligned with said radially oriented threaded openings in said webs, threaded fasteners extending through said openings in said curved metal blades and into said radially oriented threaded openings in said webs for securing said curved metal blades to said body, and a shank connected to and extending from one of said cylindrical bodies along said axis and adapted to be received within a drive member for rotating said bodies and blades.

13. The tandem honing device of claim 12 wherein said generally cylindrical bodies each include axial passageways disposed behind said curved blades and further including a resilient damper disposed in each of said axial passageways.

14. The tandem honing device of claim 12 wherein said abrasive coating is one of cubic boron nitride and diamond having a grit of between 60 and 240.

15. The tandem honing device of claim 12 wherein said coaxial member includes threads on each end and each of said bodies of said honing tools includes an axial threaded opening adapted to receive said coaxial member.

16. The tandem honing device of claim 12 wherein said coaxial member is one of a plurality of members having different lengths, one of which can be selected to separate said bodies a desired distance.

* * * * *